US010952507B2

(12) United States Patent
Hughes et al.

(10) Patent No.: US 10,952,507 B2
(45) Date of Patent: Mar. 23, 2021

(54) SHOE INSERT

(71) Applicant: AVERY DENNISON RETAIL INFORMATION SERVICES, LLC, Mentor, OH (US)

(72) Inventors: Caroline Hughes, Nottingham (GB); James Toms, Jr., Tualatin, OR (US)

(73) Assignee: Avery Dennison Retail Information Services, LLC, Mentor, OH (US)

( * ) Notice: Subject to any disclaimer, the term of this patent is extended or adjusted under 35 U.S.C. 154(b) by 0 days.

(21) Appl. No.: 16/120,848

(22) Filed: Sep. 4, 2018

(65) Prior Publication Data

US 2019/0069642 A1 Mar. 7, 2019

Related U.S. Application Data

(60) Provisional application No. 62/553,226, filed on Sep. 1, 2017.

(51) Int. Cl.

| | |
|---|---|
| ***A43D 3/14*** | (2006.01) |
| ***A43D 3/04*** | (2006.01) |
| ***B65D 81/05*** | (2006.01) |
| ***B65D 85/18*** | (2006.01) |

(52) U.S. Cl.

CPC ..... *A43D 3/1433* (2013.01); *A43D 3/04* (2013.01); *B65D 81/052* (2013.01); *B65D 85/187* (2013.01); *A43D 3/145* (2013.01)

(58) Field of Classification Search

CPC ..... A43D 3/04; A43D 3/1433; A43D 3/1441; A43D 3/145; A43D 3/1466; A43D 3/1475; B65D 81/052; B65D 85/187

USPC ..... 12/114.4, 128 R

See application file for complete search history.

(56) References Cited

U.S. PATENT DOCUMENTS

| | | | | |
|---|---|---|---|---|
| 1,086,782 | A * | 2/1914 | Moore | A43D 3/04 12/114.4 |
| 1,493,605 | A | 5/1924 | Comstock | |
| 2,838,872 | A | 6/1958 | Beck | |
| 3,729,759 | A | 5/1973 | Szabo | |
| 4,571,853 | A | 2/1986 | Medrano | |
| 5,341,532 | A | 8/1994 | Markowitz | |
| 5,348,157 | A | 9/1994 | Pozzo | |
| 5,769,231 | A | 6/1998 | Batsford | |
| 5,830,780 | A | 11/1998 | Dennison et al. | |

(Continued)

FOREIGN PATENT DOCUMENTS

| | | |
|---|---|---|
| CN | 2069663 U | 1/1991 |
| CN | 201813961 U | 5/2011 |

(Continued)

OTHER PUBLICATIONS

International Search Report and Written Opinion of the ISA/EPO dated Nov. 20, 2018 prepared for PCT/US2018/049348.

(Continued)

*Primary Examiner* — Ted Kavanaugh

(57) ABSTRACT

The present invention relates to a shoe insert that is inflatable or otherwise conformable to the interior of a shoe and provides protection against the shoe collapsing or otherwise becoming deformed during transport, shipment or handling. The shoe insert is capable of being inflated in a left or right orientation and can be provided with branding and other merchandising information.

18 Claims, 5 Drawing Sheets

(56) References Cited

U.S. PATENT DOCUMENTS

| | | | | |
|---|---|---|---|---|
| 5,912,058 | A * | 6/1999 | Takahashi | B32B 27/10 428/34.3 |
| 6,015,047 | A * | 1/2000 | Greenland | B31D 5/0073 206/522 |
| 6,971,135 | B2 | 12/2005 | Nadler | |
| D514,680 | S | 2/2006 | Chen | |
| 7,395,617 | B2 | 7/2008 | Christensen et al. | |
| 9,085,405 | B2 | 7/2015 | Frayne et al. | |
| 2005/0241081 | A1* | 11/2005 | Nadler | A43D 3/04 12/114.4 |
| 2006/0005328 | A1 | 1/2006 | Johnson | |
| 2011/0233101 | A1* | 9/2011 | Baines | B65D 81/052 206/522 |
| 2015/0175332 | A1* | 6/2015 | Dainotti | B65D 81/052 206/522 |
| 2015/0239633 | A1* | 8/2015 | Wetsch | B65D 81/052 428/12 |
| 2015/0291336 | A1* | 10/2015 | Wetsch | B65D 81/052 428/43 |
| 2016/0137355 | A1* | 5/2016 | Wetsch | B65D 33/008 426/122 |
| 2016/0340103 | A1* | 11/2016 | Yoshifusa | B65D 81/054 |
| 2017/0065032 | A1 | 3/2017 | Hughes et al. | |
| 2017/0071292 | A1 | 3/2017 | Wetsch et al. | |
| 2017/0217660 | A1* | 8/2017 | Zhang | B65D 81/03 |
| 2019/0144190 | A1* | 5/2019 | Zhang | B65D 81/03 383/3 |

FOREIGN PATENT DOCUMENTS

| | | |
|---|---|---|
| DE | 202009000336 U1 | 8/2009 |
| WO | 01/82736 | 11/2001 |

OTHER PUBLICATIONS

International Preliminary Report on Patentability dated Mar. 12, 2020 issued in corresponding IA No. PCT/US2018/049348 filed Sep. 4, 2018.

* cited by examiner

SHOE INSERT

CROSS REFERENCE TO RELATED APPLICATION(S)

The present application claims priority to and the benefit of U.S. Provisional Patent Application No. 62/553,226 filed on Sep. 1, 2017 which is incorporated by reference herein in its entirety.

BACKGROUND OF THE INVENTION

The present invention relates generally to an insert for an article such as footwear, but not limited to such. For instance, the present invention relates to an insert for shoes for men's, women's, children's, athletic, formal, casual, boots and the like as well as other apparel accessories that may include an interior space that could become damaged during transportation, storage or handling. More particularly, the present disclosure relates to shoe inserts that are made of one or more layers of plastic material such as polyethylene or polypropylene, and sealed along the end and side edges in such a manner as to allow inflation by various means.

Typically, all types of footwear are transported from the manufacturing facility to a retail location of customer, oftentimes globally. During transport, damage to the footwear's integrity and/or shoe structure can occur, that is a shoe can become deformed by crushing or other forces encountered during shipment. However, shoe manufacturers cannot bulk up or add additional packaging to the footwear, as manufacturers must meet packaging reduction requirements in various global geographies, and provide supply chain cost savings. If footwear is crushed or otherwise deformed during shipment, the aesthetic appeal of the footwear could be diminished thereby making the footwear less saleable.

It is therefore desirable to have a shoe insert that provides protection for the shoe structure and integrity during transportation including, without limitation: (1) maintaining the natural "fall" of the fore-shoe area; (2) supporting the outer edges of the shoe; and (3) controlling uplift. It is also desirable to have a shoe insert that can be easily installed in, and subsequently removed from, a shoe, and that meets or exceeds packaging reduction requirements in various global geographies. Finally, it is desirable to have a shoe insert that provides supply chain cost savings through handling and waste disposal efficiencies.

Accordingly, the present invention discloses a shoe insert comprised of a pair of shoe insert portions that are each made of one or more layers of plastic material such as polyethylene or polypropylene, and sealed in such a manner as to allow for the inflation of one or more interior chambers by various means.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

In one exemplary embodiment, an insert is described and includes at least a first insert portion and a separate second insert portion. While the present invention discusses the insert in relation to a shoe, the present application is not limited to such. The first insert portion in one embodiment, is an elongated tube-like structure that can be inserted into a shoe adjacent to a substantial portion of the interior perimeter of said shoe. The tube-like structure may be inflatable. The second insert portion may be comprised of an inflatable, multi-chambered structure that can also be positioned in the interior of the shoe, at least partially between a first end and a second end of said first insert portion. Each of said first and second insert portions of the shoe insert may be comprised of a polyethylene or polypropylene film extruded, printed, heat sealed and die cut in one single piece to match specific shoe styles and sizes as described herein. Each of said insert portions is sealed along its edges in a nearly continuous, partially continuous, or fully continuous fashion other than one area where a self-sealing inflation valve is provided. The inflation valve permits air or other gas to be inserted into the interior of the insert portion so as to fully inflate the same. In one embodiment, presently contemplated, and illustrated in FIG. 5, which will be described later in the specification, the present invention contemplates that the structure may have a single chamber rather than multiple, distinguishable champers.

In a further exemplary embodiment, the shoe insert will be provided with a re-closable inflation valve allowing the shoe insert to form fit the shoe. Additionally, a branding or customer facing capability can be printed on the inside or outside of the shoe insert. Other indicia can be provided including instructions for recycling or other marketing, promotional or use details.

Other features and advantages of the present invention will become apparent to those skilled in the art from the following detailed description. It is to be understood, however, that the detailed description of the various embodiments and specific examples, while indicating preferred and other embodiments of the present invention, are given by way of illustration and not limitation. Many changes and modifications within the scope of the present invention may be made without departing from the spirit thereof, and the invention includes all such modifications.

DETAILED DESCRIPTION OF THE INVENTION

Figure 1:
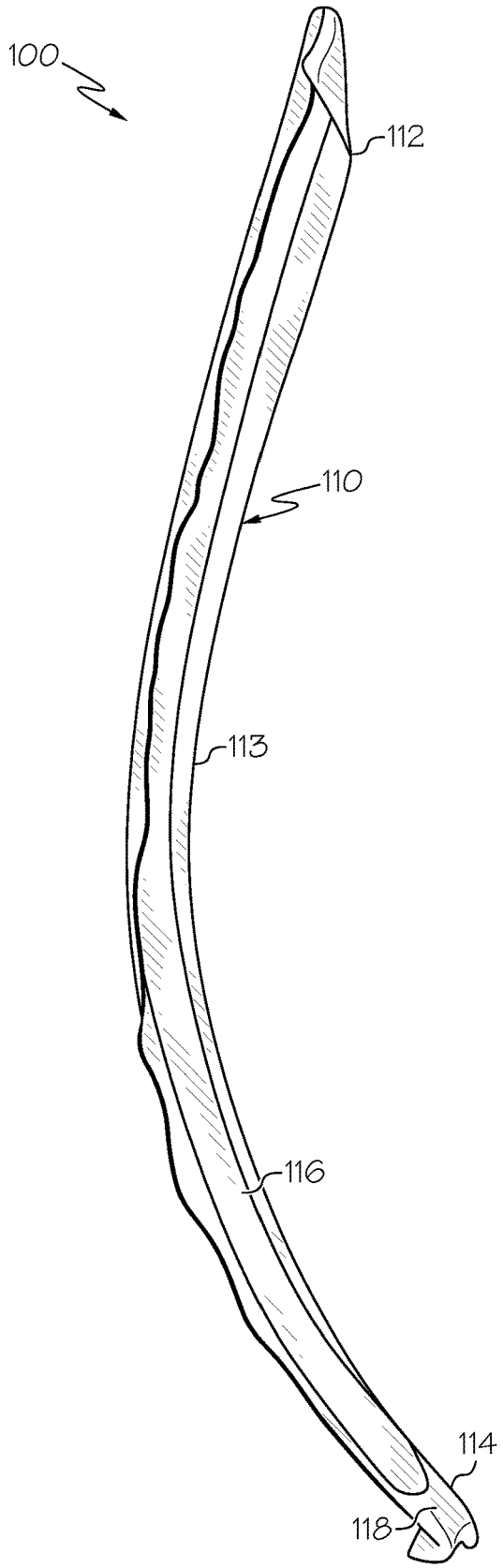
FIG. 1 is a perspective view of a preferred embodiment of the first insert portion of the shoe insert of the present invention.

The innovation is now described with reference to the drawings, wherein like reference numerals are used to refer to like elements throughout. In the following description, for purposes of explanation, numerous specific details are set forth in order to provide a thorough understanding thereof.

It may be evident, however, that the innovation can be practiced without these specific details. In other instances, well-known structures and devices are shown in block diagram form in order to facilitate a description thereof. In this disclosure, any identification of specific shapes, materials, techniques, arrangements, etc. are either related to a specific example presented or are merely a general description of such shape, material, technique, arrangement, etc. Identification of specific details or examples are not intended to be, and should not be, construed as mandatory or limiting unless specifically designated as such.

In one embodiment of the present invention, shoe insert 100 is comprised of a first insert portion 110 and a second insert portion 130. As best illustrated in FIG. 1, first insert portion 110 is preferably an elongated inflatable tube-like structure that can be inserted into a shoe adjacent to a substantial portion of the interior perimeter of said shoe. First insert portion 110 is comprised of a first end 112, a middle portion 113, an opposing second end 114, an inflatable chamber 116 and an inflation valve 118 that permits air or other gases to be inserted into inflatable chamber 116 so as to fully inflate first insert portion 110.

First insert portion 110 of shoe insert 100 is preferably comprised of a polyethylene or polypropylene film extruded, printed, heat sealed and die cut in one single piece to match specific shoe styles and sizes as described herein. More specifically, first insert portion 110 is formed by heat sealing the edges of two layers of film to form inflatable chamber 116 that will retain the air or gas once first insert portion 110 is inflated. In a further preferred embodiment of the present invention, first insert portion 110 is made with 100% virgin polyethylene and nylon resins, which are recyclable materials, thereby making first insert portion 110 recyclable. First insert portion 110 may also be made from recycled materials.

First insert portion 110 is sealed along its edges in a nearly continuous fashion other than where self-sealing inflation valve 118 is provided to allow for the inflation/deflation of chamber 116 of first insert portion 110. Because first insert portion 110 is inflatable, it can be form fitted to the particular shoe in which it is installed. First insert portion 110 may be manually inflated, or inflated by a machine (not shown). Once inflated, first insert portion 110 may remain in an inflated state for more than 90 days.

Figure 2:
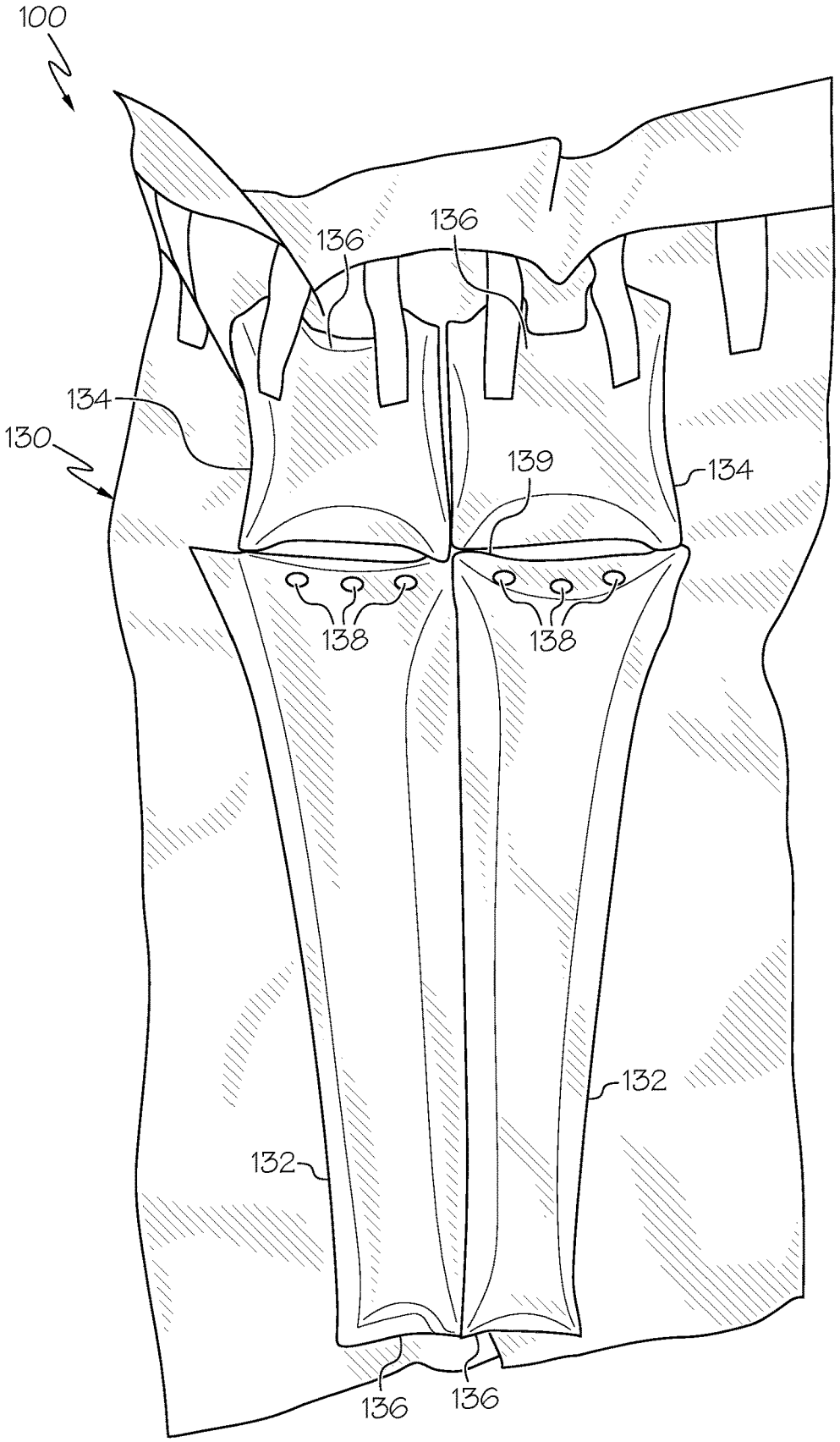
FIG. 2 is a perspective view of a preferred embodiment of the second insert portion of the shoe insert of the present invention.

As best illustrated in FIG. 2, second insert portion 130 is preferably comprised of an inflatable, multi-chambered structure that can also be positioned in the interior of a shoe, at least partially between first end 112 and second end 114 of first insert portion 110, as more fully described below. More specifically, second insert portion 130 is comprised of at least one, and preferably two, inflatable forward chambers 132, at least one, and preferably two, inflatable rear chambers 134, and an inflation valve 136 that permits air or other gases to be inserted into inflatable chambers 132, 134 so as to fully inflate second insert portion 130.

Figure 3:
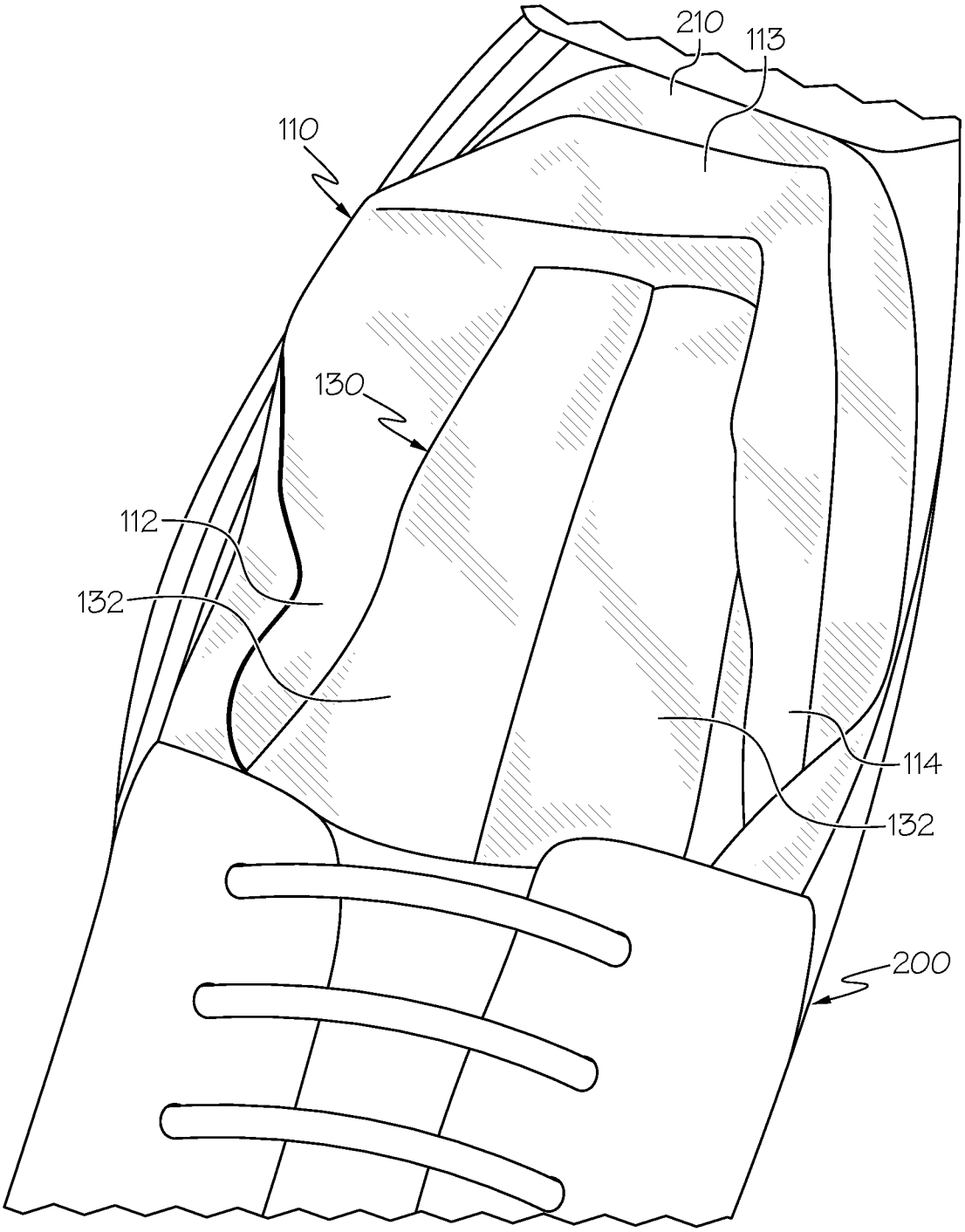
FIG. 3 is a top perspective view of a preferred embodiment of the shoe insert of the present invention installed in a shoe, wherein the top portion of the shoe has been removed to illustrate the preferred positioning of the shoe insert within said shoe.

As best shown in FIG. 3, forward chambers 132 are generally conically shaped chambers that extend outwardly from rear chamber 134 into the toe-box of a shoe, at least partially between first end 112 and second end 114 of first portion 110, when properly installed. In a preferred embodiment of the present invention, the width and thickness of forward chambers 132 are greatest immediately adjacent to rear chambers 134 and taper off as forward chambers 132 extend into the toe-box, thereby helping to maintain the natural fall of the fore-shoe area when inflated. As best shown in FIG. 2, rear chambers 134 are generally rectangular in shape and extend outwardly from forward chambers 132 to assist in supporting the tongue area of the shoe.

Similar to first insert portion 110, second insert portion 130 of shoe insert 100 is also preferably comprised of a polyethylene or polypropylene film extruded, printed, heat sealed and die cut in one single piece to match specific shoe styles and sizes as described above. More specifically, forward and rear chambers 132, 134 of second insert portion 130 are formed by heat sealing the edges of two layers of film to form inflatable voids (i.e., the chambers) that will retain the air or gas once second insert portion 130 is inflated. In a further preferred embodiment of the present invention, second insert portion 130 is made with 100% virgin polyethylene and nylon resins, which are recyclable materials, thereby making second insert portion 130 recyclable. Second insert portion 130 may also be made from recycled materials.

In a preferred embodiment of the present invention, second insert portion 130, and each of forward chambers 132 and rear chambers 134, is substantially sealed along its edges in a nearly continuous fashion other than where self-sealing inflation valve(s) 136 is/are provided to allow for the inflation/deflation of second insert portion 130. More specifically, a separate inflation valve 136 may be included for each of forward chambers 132 and rear chambers 134 or, alternatively, relatively small openings or pathways 139 can be provided between the various forward and rear chambers 132, 134 to permit each of said chambers to be in air communication with one another and thereby only requiring a single inflation valve 136 to inflate the entirety of second insert portion 130. Because second insert portion 130 is inflatable, it too can be form fitted to the particular size and shape of the shoe in which it is installed. Second insert portion 130 may be manually inflated, or inflated by a machine (not shown). Once inflated, second insert portion 130 may remain in an inflated state for more than 90 days.

As best shown in FIG. 2, second insert portion 130 may further comprise heat seal "dot" components 138 that force air out and up during the inflation process providing support for the shoe in the vamp and laces area. These heat seal components 138 are heat sealed "dots" that are inserted during the die cutting process and act to direct air flow as the second insert portion 130 is being inflated via the inflation valve 136. In an alternative embodiment, one or more heat seal components 138 may be used to direct the orientation of second insert portion 130 so that second insert portion 130 forms a left or right orientation upon inflation. For example, the toe box or front section of the second insert portion can be pivoted about one or more of the heat seal components 138 to change the orientation to a left or right shoe so that second insert portion 130 better fits within a shoe. More specifically, heat seal components 138 can be positioned on one side or the other of a center line of the second insert portion 130 so that second insert portion 130 will automatically divert in the left or right orientation upon inflation. Alternatively, if heat seal component 138 is disposed centrally of the second insert portion 130, the front portion of the insert can be pivoted or shifted around the heat seal component 138 to form a left or right orientation.

Having described the general structure of shoe insert 100, its deployment, use and function will now be further described. To insert first insert portion 110 into a shoe 200, first insert portion 110 is typically bent into a generally U-shaped structure and inserted into shoe 200 in an uninflated state adjacent to a substantial portion of the interior perimeter of shoe 200. More specifically, middle portion 113 of first insert portion 110 is generally positioned in a toe-box portion 210 of shoe 200, and each of first end 112 and second end 114 extend backwardly from the toe-box portion 210 towards a rear portion 220 of shoe 200, substantially adjacent to the interior perimeter of shoe 200.

As previously noted and as best illustrated in FIG. 2, second insert portion 130 is preferably comprised of two side by side forward chambers 132 and two side by side rear chambers 134. Forward chambers 132 extend outwardly from rear chambers 134 into the toe-box portion 210 of shoe 200, at least partially between first end 112 and second end 114 of first portion 110. In a preferred embodiment of the present invention, the width and thickness of forward chambers 132 are greatest immediately adjacent to rear chambers 134 and taper off as forward chambers 132 extend into toe-box 210 of shoe 200, thereby helping to maintain the natural fall of the fore-shoe area when inflated.

FIG. 3 is a top perspective view of a preferred embodiment of shoe insert 100 installed in shoe 200, wherein the top portion of shoe 200 has been removed to illustrate the preferred positioning of shoe insert 100. More specifically, FIG. 3 depicts first insert portion 110 looping around the interior perimeter of shoe 200 with the middle portion 113 of first insert portion 110 positioned substantially in toe box 210. Further, forward chambers 132 are positioned at least partially between first end 112 and second end 114 of first portion 110 and also extend into toe-box portion 210. Because the width and thickness of forward chambers 132 are greatest immediately adjacent to rear chambers 134 and taper off as forward chambers 132 extend into the toe-box portion 210, first insert portion 110 and forward chambers 132 of second insert portion 130 help to maintain the natural fall of the fore-shoe area when inflated.

Figure 4:
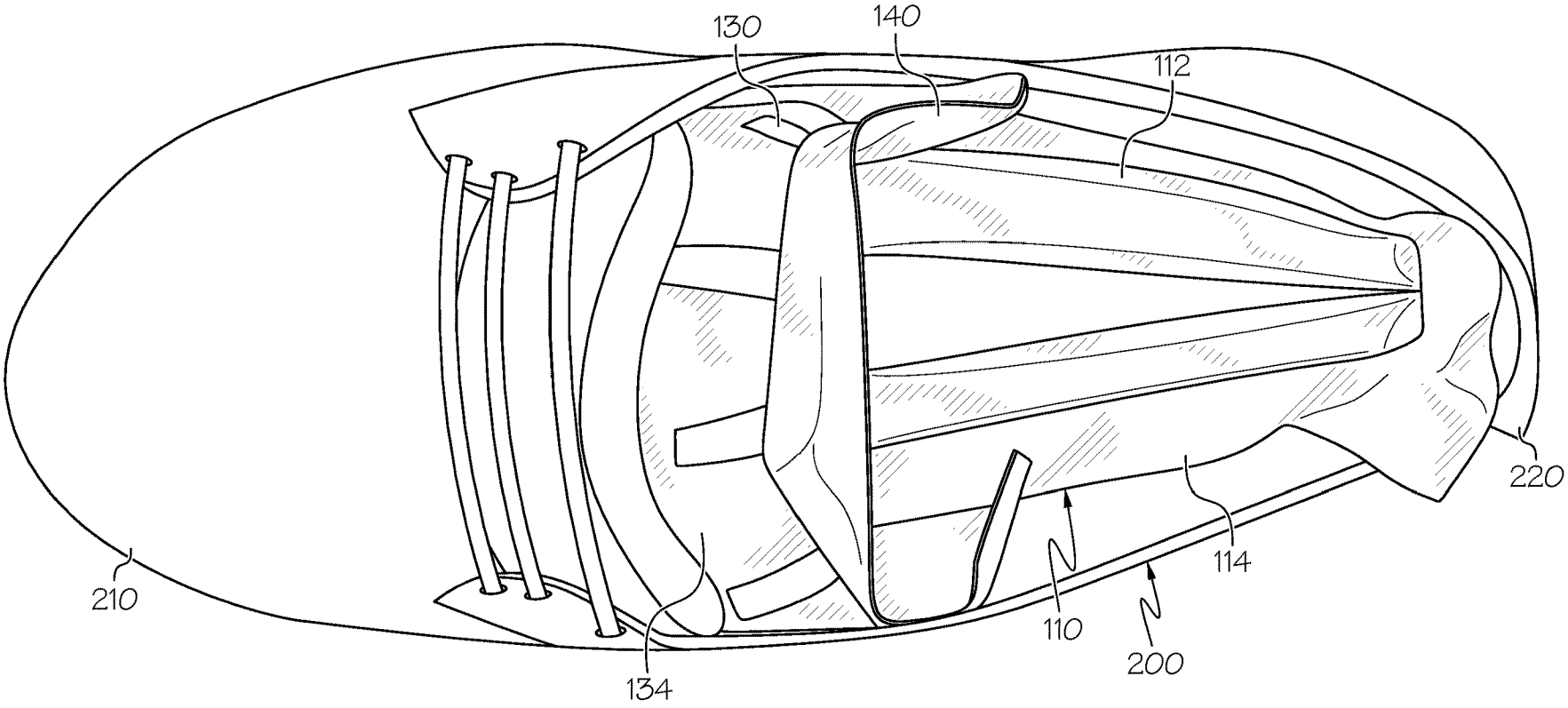
FIG. 4 is a top perspective view of one embodiment of the shoe insert of the present invention installed in a shoe.

FIG. 4 is a top perspective view of a preferred embodiment of shoe insert 100 of the present invention installed in shoe 200. More specifically, FIG. 4 depicts the first end 112 and second end 114 of first insert portion 110 extending from toe-box portion 210 back towards the rear portion 220 of shoe 200. FIG. 4 further depicts a portion of rear chambers 134 positioned above first insert portion 110 and immediately adjacent to the tongue of shoe 200. As previously discussed, rear chambers 134 are generally rectangular in shape and extend outwardly from forward chambers 132 to assist in supporting the tongue area of shoe 200.

As previously stated, first and second insert portions 110, 130 may be manually inflated or inflated by machine and are typically capable of remaining in an inflated state for more than 90 days. Typically, first and second insert portions 110, 130 are inflated after insertion into the shoe 200, however they can be inflated before insertion as well. If first and second insert portions 110, 130 are inflated before insertion into shoe 200, a waste portion 140 around each of first and second insert portions 110, 130 is torn off before or after inflation. The waste portion 140 is only present due to the tooling required to produce the shapes of shoe insert 100 and does not impact inflation. If the shoe inserts 100 are produced in sheets of material, the entire sheet could be inflated at the same time and then the inflated shoe inserts 100 could be removed from the sheet and inserted into the shoes.

Additionally, customer facing or branded graphics, artwork, and/or messages 300 can be printed on the inside or outside of the first insert portion 110, second insert portion 130, or both, depending on the needs and wants of the manufacturer.

The benefits of the shoe insert of the present invention are numerous and include, without limitation, providing protection for the shoe structure and integrity during the transportation from manufacturing country of origin to retail store globally by: (1) maintaining the natural "fall" of the fore-shoe area; (2) supporting the outer edges of the shoe; and (3) controlling uplift. The shoe insert of the present invention can also be easily installed in, and subsequently removed from, a shoe, and meets or exceeds packaging reduction requirements in various global geographies. Finally, the shoe insert of the present invention provides supply chain cost savings through handling and waste disposal efficiencies.

The shoe insert 100 of the present invention provides protection for the toe-box 210 and the shape of the shoe 200 during transportation, shipping and handling and prevents the shoe 200 from becoming wrinkled or collapsing during the shipment such that the shoe 200 arrives at its intended retail destination and can be displayed for the retail consumer.

Figure 5:
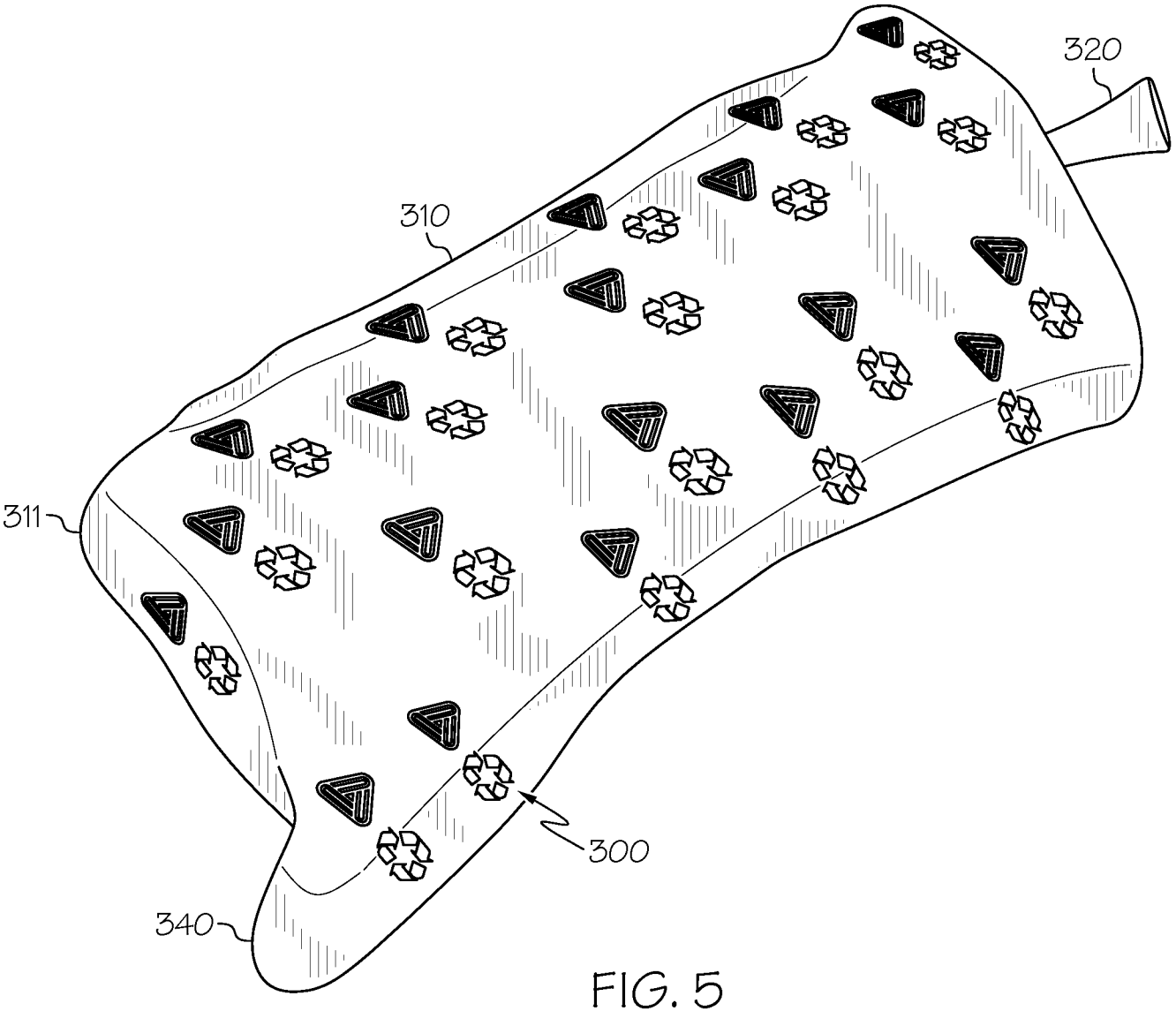
FIG. 5 is a perspective view of another embodiment of the shoe inert of the present invention.

The shoe insert 200 of the present invention can be created in any number of sizes or styles for men's, women's or children's shoes, boots or other footwear. For instance, as illustrated in FIG. 5, the insert 300 is an inflatable tube-like structure that can be inserted into an article. In one embodiment the insert 300 is rectangular, but is not limited to such a shape. The insert 300 has a width 310 substantially the same or the same along the length 311 of the insert 300 and is a singular chamber structure. The insert 300, may have at least one elongated portion 340. First insert 300 may be sealed in a nearly continuous fashion other than where valve 320 is provided.

It will thus be seen according to the present invention a highly advantageous shoe insert has been provided. While the invention has been described in connection with what is presently considered the most practical and preferred embodiment, it will be apparent to those of ordinary skill in the art that the invention is not to be limited to the disclosed embodiment, and that many modifications and equivalent arrangements may be made thereof within the scope of the invention, which scope is to be accorded the broadest interpretation of appended claims so as to encompass all equivalent structures and products. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A shoe insert for insertion into an interior space of a shoe comprising:

a first insert portion comprised of a first end, a second end and a middle portion; and a second insert portion comprising at least one forward chamber extending from at least one rear chamber, wherein each of the first insert portion and second insert portion are inflatable;

wherein the first insert portion is not attached to the second insert portion; and wherein the second insert portion is positioned substantially between the first end and the second end of the first insert portion.

2. The shoe insert of claim 1, wherein each of the first insert portion and the second insert portion comprise an inflation valve.

3. The shoe insert of claim 2, wherein each inflation valve is a self-sealing inflation valve.

4. The shoe insert of claim 1, wherein the middle portion is configured to be positioned substantially in a toe-box portion of a shoe.

5. The shoe insert of claim 1 wherein each of the first insert portion and the second insert portion is comprised of an extruded material, having printed indicia and die cut to fit within the shoe.

6. The shoe insert of claim 5 wherein the die cut of the second insert portion is sealed substantially around its edges, and wherein at least one sealed area is created within an inner area of the die cut of the second insert portion to create separation zones between one or more of said at least one inflatable forward chamber and at least one inflatable rear chamber.

7. The shoe insert of claim 1 wherein said second insert portion further comprises at least one heat sealed component.

8. The shoe insert of claim 7 wherein the at least one heat sealed component is configured to direct air flow during inflation of the second insert portion or to direct an orientation of the second insert portion.

9. The shoe insert of claim 1 wherein each of the first insert portion and the second insert portion are comprised of a single piece of extruded, multi-layer polyethylene or polypropylene material.

10. The shoe insert of claim 1 wherein a portion of the shoe insert has a printed text or graphic thereon.

11. A shoe insert comprising:

a first insert portion comprised of a first end, a second end and a middle portion;

a second insert portion comprised of a plurality of inflatable chambers; and a separate inflation valve in the first insert portion and each of the plurality of inflatable chambers of the second insert portion;

wherein the first insert portion is not attached to the second insert portion; and wherein the second insert portion is positioned substantially between the first end and the second end of the first insert portion.

12. The shoe insert of claim 11 wherein each of said first insert portion and said second insert portion is comprised of an extruded multi-layer polyethylene or polypropylene material.

13. The shoe insert of claim 12 wherein the multi-layer polyethylene or polypropylene material is printed with at least one of customer facing or branded graphics, artwork, and messages and die cut.

14. The shoe insert of claim 11 wherein the plurality of inflatable chambers comprises at least one generally conically shaped forward chamber extending outwardly from at least one rear chamber.

15. The shoe insert of claim 11 wherein at least one of said plurality of inflatable chambers comprises a heat seal component.

16. The shoe insert of claim 14 wherein said plurality of inflatable chambers comprises two generally conically shaped forward chambers extending outwardly from two rear chambers.

17. A shoe insert comprising:

a first insert portion comprised of a multi-layered material with heat sealed edges and an inflatable interior, and an inflation valve, wherein the first insert portion is comprised of a first end, a second end and a middle portion;

a second insert portion comprised of a multi-layered material with heat sealed edges, and comprising an inflatable interior, at least one heat seal component configured to direct the orientation of the second insert portion upon inflation, and an inflation valve, wherein the inflatable interior of the second insert portion is segmented into one or more chambers;

wherein the first insert portion is not attached to the second insert portion; and wherein the second insert portion is positioned substantially between the first end and the second end of the first insert portion.

18. The shoe insert of claim 17 wherein the at least one heat seal component is positioned on one side or another of a center line of the second insert portion.

* * * * *